United States Patent [19]

Wagner

[11] Patent Number: 4,934,534

[45] Date of Patent: Jun. 19, 1990

[54] SOFT CONTAINER FOR DENTAL APPLIANCES

[75] Inventor: Eugene C. Wagner, Chappaqua, N.Y.

[73] Assignee: Dental Concepts, Inc., Elmsford, N.Y.

[21] Appl. No.: 674,424

[22] Filed: Nov. 23, 1984

[51] Int. Cl.[5] ..... B65D 81/02

[52] U.S. Cl. ..... 206/568; 206/523; 206/810

[58] Field of Search ..... 206/523, 56 P, 810; 152/118, 52 R

[56] References Cited

U.S. PATENT DOCUMENTS

| | | | |
|---|---|---|---|
| 2,541,002 | 2/1951 | Wells | 150/52 R |
| 2,604,919 | 7/1952 | Harwood | 150/52 R |
| 3,865,166 | 2/1975 | Pedro | 150/52 R |
| 3,901,384 | 8/1975 | Lee et al. | 206/523 |
| 4,071,043 | 1/1978 | Carlson | 206/523 |
| 4,241,829 | 12/1980 | Hardy | 206/523 |
| 4,306,601 | 12/1981 | Wallis et al. | 206/52 |
| 4,383,565 | 5/1983 | Denmat | 206/523 |
| 4,386,702 | 6/1983 | Schultz et al. | 206/523 |
| 4,446,900 | 5/1984 | Markovich | 150/52 R |

FOREIGN PATENT DOCUMENTS

| | | | |
|---|---|---|---|
| 572678 | 11/1958 | Belgium | 150/52 R |
| 2411610 | 3/1974 | Fed. Rep. of Germany | 150/52 R |
| 2438523 | 2/1976 | Fed. Rep. of Germany | 150/52 R |
| 345125 | 4/1960 | Switzerland | 150/52 R |

*Primary Examiner*—Joseph Man-Fu Moy
*Attorney, Agent, or Firm*—Natter & Natter

[57] ABSTRACT

A soft container for dental appliances includes a shell having a top and a bottom panel interconnected by a hinge panel. All of the shell panels are formed of a single piece of water repellent fabric. A lip extends along the periphery of the top and bottom panels and the case is opened and closed with a slide fastener which selectively joins the opposed lips. A replaceable liner is formed of a unitary slab of compressible foam which is folded into leaves adjacent the hinge panel. Between the two leaves of the liner, one or more dental appliances such as denture or orthodontic plates are placed and the shell is then closed with the slide fastener.

10 Claims, 2 Drawing Sheets

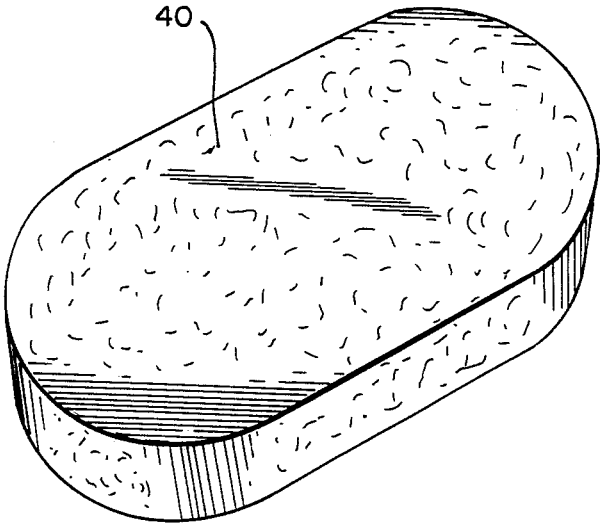
FIG. 3
FIG. 4
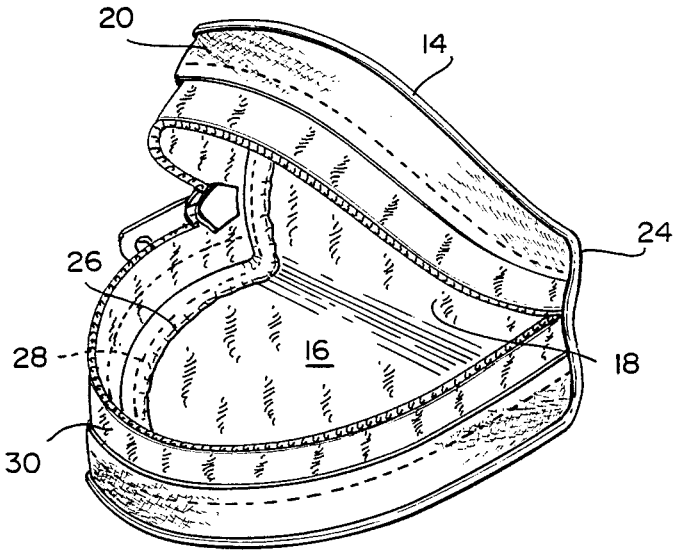

SOFT CONTAINER FOR DENTAL APPLIANCES

TECHNICAL FIELD

This invention relates generally to dental apparatus and more particularly to storage devices for personal dental appliances such as dentures and orthodontic plates.

BACKGROUND ART

Removable dental appliances have been in widespread usage by people for many years. Among such appliances were partial dentures, full dentures, bridges and orthodontic appliances such as retainers, bite plates and similar devices.

It has been found that people who have worn removable dental appliances often desired to temporarily remove the appliance from the oral cavity due to discomfort or due to a regimen of limited duration prescribed usage or for the purpose of sleeping.

While one customarily envisioned dental plates carried in a drinking glass on a night stand and submerged in water, this traditional storage mode was not necessarily the most advantageous for use with other dental appliances such as orthodontic devices and was clearly not suitable for situations where an ambulatory individual desired to temporarily remove an appliance when not at home. In such instances, the primary objectives were to obtain a suitable storage medium, avoid embarassment, and protect the appliance from damage.

One suggested container for dentures was illustrated in U.S. Pat. No. 2,620,919 wherein a hard shell spherical container included an outer case having a pair of hinged hemispherical lids. Each lid carried a sponge rubber insert which included a contoured cavity for receiving a dental plate.

This device did not gain widespread acceptance and it is doubtful whether it ever was commercialized. A primary disadvantage of the device was that it was relatively large and bulky and not susceptible to inconspicuous placement in a person's pocket. Further, because of the hard spherical exterior it was necessary to contour the sponge rubber to provide the cavity for receiving the denture and a protective flap to extend over the denture.

It would further appear that the device which included a recessed mechanical hinge and latch for securing the half spherical exterior portions, as well as the particular contoured configuration of the sponge inset, entailed significant manufacturing costs in both components and labor. Further, the use of metal components, e.g. hinge pins, latches, etc., created a potential for rusting and rendered the container difficult to keep clean.

DISCLOSURE OF THE INVENTION

In compendium, the present invention comprises a soft container for dental appliances which includes an outer flexible shell comprising a folded single piece of water repellent fabric, a lip extending along the periphery of the panels and a non-metallic slide fastener closure joined to the skirt. A replaceable liner is formed of a single piece slab of compressible foam and is received in the shell. In use, one or more dental appliances are placed between folded leaves of the foam liner and the slide fastener secures the top and bottom panels of the shell.

Since the foam liner and the shell are both yieldable, the container deforms slightly to receive the appliance; the closed container may be placed inconspicuously in a user's pocket, and the compressible nature of the entire container is such that the appliance is protected against breakage.

The foam liner is removed when it is desired to clean the case and may be separately washed or entirely replaced. In addition, the foam liner may be impregnated with a suitable antiseptic if desired.

From the foregoing compendium, it will be appreciated that it is an object of the present invention to provide a soft container for dental appliances of the general character described which is not subject to the disadvantages of the background art aforementioned.

A further aspect of the present invention is to provide a soft container for dental appliances of the general character described which assures protection for a stored dental appliance against potential damage from dropping, jarring, or inadvertent externally applied forces.

Another feature of the present invention is to provide a soft container for dental appliances of the general character described which is light in weight.

A further aspect of the present invention is to provide a soft container for dental appliances of the general character described which occupies but a modicum of volume and is thus suitable for inconspicuous usage.

A further feature of the present invention is to provide a soft container for dental appliances of the general character described which is suited for instantaneous usage without requiring the addition of liquids.

An additional aspect of the present invention is to provide a soft container for dental appliances of the general character described which is easy to clean.

An additional feature of the present invention is to provide a soft container for dental appliances of the general character described which includes replaceable liners for maintaining sanitary conditions.

Another feature of the present invention is to provide a soft container for dental appliances of the general character described which is low in cost and suitable for manufacture by mass production fabrication techniques.

Other objects, features and aspects of the present invention in part will be obvious and in part will be pointed out hereinafter.

With these features, objects, aspects and advantages in mind, the invention finds embodiment in the various combinations of elements and arrangements of parts by which the invention is achieved, all with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention:

FIG. 3 is a perspective illustration of a replaceable foam liner; and

FIG. 4 is a perspective view of the container shell with the liner removed and showing the interior construction of the case.

DESCRIPTION OF THE PREFERRED EMBODIMENT

Figure 1:
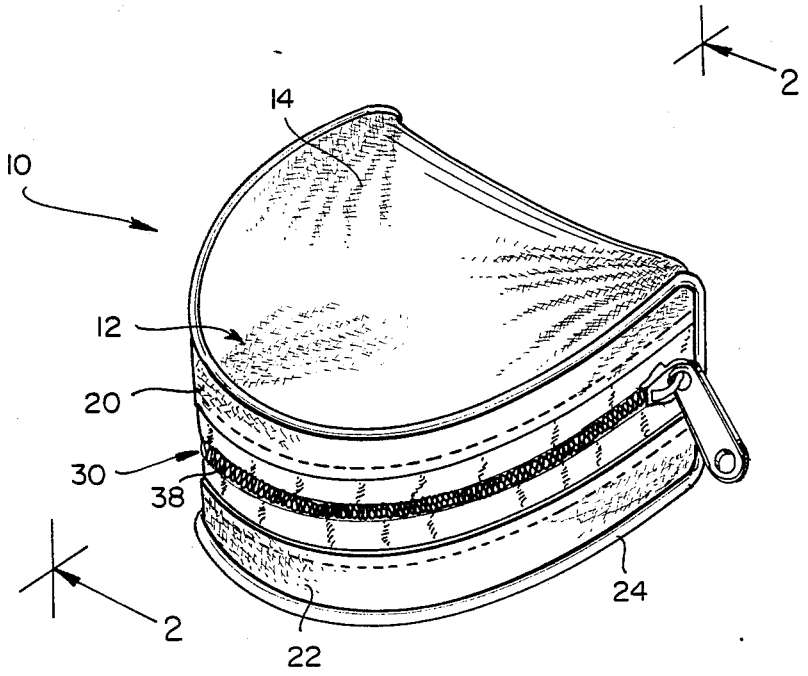
FIG. 1 is a perspective view of a soft container for dental appliances constructed in accordance with and embodying the present invention and showing an outer shell formed of fabric.

Referring now in detail to the drawings, the reference numeral 10 denotes generally a soft container for dental appliances constructed in accordance with and embodying the invention. The container 10 includes an outer shell 12 which is formed of a registered top panel 14 and bottom panel 16 which are joined together through a hinge panel 18. The top and bottom panels 14, 16 are in the general shape in plan configuration of the letter D and include an arcuately curved peripheral edge having a radius of approximately 4 cm. Pursuant to the invention the top panel 14 and bottom panel 16 and hinge panel 18 are formed of a single piece of flexible fabric such as 400 denier woven nylon, DuPont type no. 66, and treated for water repellency with, for example, a three-quarter ounce urethane coating.

Figure 2:
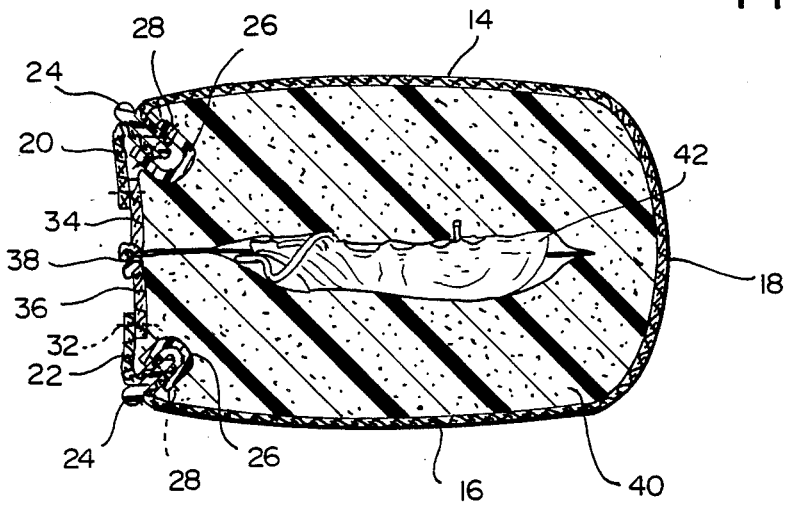
FIG. 2 is an enlarged scale sectional view through the container, the same being taken substantially along the plane 2—2 of FIG. 1 and illustrating an orthodontic appliance protectively stored within the container and cushioned by a compressible foam liner.

A downwardly projecting lip 20 is secured adjacent the peripheral edge of the top panel 14 and a similar lip 22 is secured adjacent the peripheral edge of the bottom panel 16 and projects upwardly therefrom. With reference to FIGS. 2 and 4 wherein details of the shell construction are illustrated, it will be seen that a beaded welt strip 24 is secured between folded-over mating peripheral edges of the top panel 14 and the lip 20 as well as the bottom panel 16 and the lip 22. Covering the folded-over peripheral edges is a binding strip 26. Suitable stitching 28 secures the binding strip 26, the folded-over edge portions and the welt strip 24. The welt strip 24 may typically comprise extruded polyvinylchloride.

To the opposite longitudinal edges of the lips 20, 22 a slide fastener 30 is secured by conventional stitching 32. The stitching 32 joins each lip 20, 22 to a respective tape 34, 36 of the slide fastener 30. The slide fastener 30 may typically comprise a polyester coil 38 with the tape portions 34, 36 formed of polyester fabric.

It should be noted that the opposite ends of the lips 20, 22, as well as the slide fastener 30, extend to the hinge panel 18 of the shell and are stitched together with a folded over portion of the hinge panel 18, the welting strip 24 and the binding strip 26.

Pursuant to the present invention, a lightweight compressible foam liner 40 is positioned within the shell 12. The liner 40 illustrated outside the shell in FIG. 3, is formed of a soft breathable synthetic foam, such as open cell polyurethane foam. It may be cut from a slab and is contoured to include parallel side walls and curved end walls having a radius of approximately 4 to 5 cm.

The liner 40 is folded to provide a pair of leaves 44, 46 in registration with one another and then placed within an opened empty shell 12 which is positioned as depicted in FIG. 4. The liner fold line is registered with the hinge panel 18 of the shell 12 and the entire liner 40 is snugly received within the shell in a slightly compressed state. The thickness of each leaf 44, 46 may be in the order of 1½ to 2 cm., and when folded over it should approximate the width of the combined lips and slide fastener 30. When the slide fastener 30 is opened, the natural resiliency of the welt 24, the binding strip 26, and the shell construction in general is such that the shell opens to an open mouth angular orientation depicted generally in FIG. 4, in the order of 20 degrees.

With the liner 40 seated within the shell 12, the liner too conforms to such configuration and is ready to receive a dental appliance such as an orthodontic retainer 42. The slide fastener 30 is then closed and the temporarily stored appliance is safely cushioned and may be placed in a pocket or purse.

It is evident that in accordance with the invention the container 10 is easy to maintain in sanitary condition in the presence of frequent usage. The liner may be removed for washing and the durable nature of the shell fabric and slide fastener 30 facilitates either hand or machine washing. In addition, the liner 40, once removed, may be separately hand washed and dried or may be easily replaced.

While in some instances, it may be desirable to maintain the stored dental appliance moist, it has been generally found that for temporary storage the dental appliance may be inserted and stored in a dry condition without concern. If desired, however, a suitable moistening liquid or an antiseptic may be adsorbed into the liner 40 to keep the appliance moist. The water repellency of the shell precludes leakage of the liquid in the presence of compressive forces on the liner.

It should also be appreciated that, should the container 10 become undesirably damp or wet from a premoistened liner or from a damp or moist appliance, it may be air dried by removing the liner 40 and leaving the shell in an open position, such as that illustrated in FIG. 4. At the same time, the removed liner 40 will air dry.

The shell 12 is preferably dimensioned to be capable of carrying a full denture or a set of full dentures. Accordingly, the shell 12 may be configured with a curve radius of approximately 4 cm. at the top and bottom panels 14, 16 and a combined thickness, i.e. hinge height, of approximately 3 cm. As mentioned heretofore, the liner 40 is dimensioned slightly larger to assure a snug fit.

Thus, it will be seen that there is provided a soft container for dental appliances which achieves the various aspects, features and objects of the present invention and which is well suited to meet the conditions of practical usage.

As various changes and alterations in the soft container for dental appliances heretofore described will be readily apparent to one skilled in the art, it is to be understood that all matter described and shown herein is to be interpreted as illustrative and not in a limiting sense.

Having thus described the invention, there is claimed as new and desired to be secured by Letters Patent:

1. A soft container for the storage of dental appliances, the container comprising a flexible shell, the shell including a top portion, a bottom portion and a unitary hinge joining the top and bottom portions, a replaceable liner, the liner comprising a general planar flexible soft foam material, the liner having one leaf adapted for registration with the top portion of the shell and another leaf adapted for registration with the bottom portion of the shell, each leaf having an outer face engaging the respective shell portion and an opposite exposed inner face for engagement with the appliance, the container further including means forming a mouth for accessing the interior of the container and closure means for opening and closing the mouth, the mouth including a lip depending from the top portion and a further lip projecting from the bottom portion, the closure means including means securing the lips together adjacent their peripheral edges, each liner leaf having a periphery shaped in conformance with its respective shell portion and being juxtaposed against the lips of its respective shell portion, a dental appliance being selectively positionable between the exposed faces of the leaves when the mouth is opened and being secured in such position when the mouth is closed, the foam material being of a thickness and compressibility sufficient to intimately egage and protect the dental appliance from injury due to dropping the container and due to normally encountered externally applied forces, the flexible shell including yielding means for self deforming in the presence of the dental appliance placed between the leaves of the liner whereby the container is suitable for inconspicuous and instantaneous usage.

2. A soft container for the storage of dental appliances as constructed in accordance with claim 1 wherein the container is so dimensioned as to accommodate a full denture.

3. A soft container for the storage of dental appliances as constructed in accordance with claim 1 wherein the top and bottom of the shell include a curved periphery, the curve having a radius in the order of 4 cm.

4. A soft container for dental appliances as constructed in accordance with claim 1 wherein the closure means comprises a slide fastener.

5. A soft container for dental appliances as constructed in accordance with claim 1 wherein the top, bottom and hinge of the shell are formed of a single piece of flexible material.

6. A soft container for the storage of dental appliances constructed in accordance with claim 5 wherein the flexible material comprises a fabric woven of thermoplastic filaments.

7. A soft container for the storage of dental appliances constructed in accordance with claim 6 wherein the fabric includes means for repelling water, whereby the container may be utilized for moist storage of dental appliances.

8. A soft container for dental appliances as constructed in accordance with claim 1 wherein the liner comprises a folded single piece of foam material.

9. A soft container for dental appliances as constructed in accordance with claim 1 wherein the thickness of each liner leaf is in the order of 1–2 cm.

10. A soft container for dental appliances constructed in accordance with claim 1 wherein the foam material comprises open cell polyurethane foam.

* * * * *